US006066371A

United States Patent [19]

Zehetner

[11] Patent Number: 6,066,371

[45] Date of Patent: May 23, 2000

[54] DECORATIVE TASSEL ASSEMBLY HAVING INTERCHANGEABLE COMPONENTS

[76] Inventor: Peter Zehetner, 5893 Enterprise Pkwy., Fort Myers, Fla. 33905

[21] Appl. No.: 09/024,642

[22] Filed: Feb. 17, 1998

[51] Int. Cl.[7] ..... B32B 7/06

[52] U.S. Cl. ..... 428/28; 16/122

[58] Field of Search ..... 428/28, 99; 28/147; 2/244; 16/122

[56] References Cited

U.S. PATENT DOCUMENTS 1,508,300 9/1924 Sacks ..... 428/28
1,618,110 2/1927 Sacks ..... 428/28
2,107,459 2/1938 Weller ..... 428/28

*Primary Examiner*—Alexander Thomas
*Attorney, Agent, or Firm*—William E. Noonan

[57] ABSTRACT

A multiple component tassel assembly includes a cord component that engages and hangs from a conventional supporting article. There is a head component having a decorative configuration and a tassel component, which includes a support member and a plurality of tassel strands that are suspended from the support member. The cord and the support member are releasably attached to the head component such that the head component depends from the cord component and the tassel component depends from the head component when the cord component is hung from a conventional supporting article.

22 Claims, 5 Drawing Sheets

DECORATIVE TASSEL ASSEMBLY HAVING INTERCHANGEABLE COMPONENTS

FIELD OF THE INVENTION

This invention relates to a decorative tassel assembly having interchangeable components and, more particularly, to an assembly which is suited for use in all types of hanging tassels and decorative curtain tie-backs.

BACKGROUND OF THE INVENTION

Tassels are used in a wide variety of decorative applications. Hanging tassels typically employ a loop that is used to suspend the tassel from a chair, lamp, curtain rod, etc. Other types of tassels employ a pair of loops, which enable the tassel to be hung on a hook or bracket and employed as a curtain tie-back.

Conventional tassels normally employ three primary components: a hanging cord, a decorative head (which may comprise various configurations); and a tassel that hangs from the head. These components are permanently interconnected at the factory. Presently, there are no tassels available that permit the homeowner to replace just the head or just the tassel strands. If, for aesthetic reasons, the homeowner decides to modify or change a particular tassel component, he or she must replace the entire product. Changing tassels may be required or desired, for instance, when a room is redecorated or in order to celebrate various holidays and special occasions. Many decorative tassels, and particularly those which employ an intricate head construction, can be fairly expensive. Collecting and maintaining a large number of these tassels can be especially costly and require considerable storage space.

Conventional tassels that employ permanently interconnected components also present problems for the retailer. Oftentimes, it is difficult for storeowners to accurately determine their precise inventory requirements for particular tassel designs. Overstocking and understocking items can increase the retailer's expense and result in customer dissatisfaction. Because the cord, head and tassel are permanently connected, the storeowner has little, if any, flexibility in modifying products to meet unexpected or changing customer demands for a particular design. In the decorative tassel industry, inventory delays are a particularly significant problem because many of these products have to be imported from foreign manufacturers.

SUMMARY OF INVENTION

It is therefore an object of the present invention to provide a decorative tassel that may be customized to an individual homeowners aesthetic tastes.

It is a further object of this invention to provide a decorative tassel having fully interchangeable parts that may be quickly and conveniently disassembled and reassembled as needed.

It is a further object of this invention to provide an assembly that permits the homeowner to interchange the decorative parts of a tassel without having to replace the tassel with an entirely new product.

It is a further object of this invention to provide a decorative tassel assembly that eliminates the need for the homeowner to purchase and store a collection of complete tassels.

It is a further object of this invention to provide a decorative tassel assembly that significantly reduces the expense and inconvenience associated with conventional tassels and tie-backs.

It is a further object of this invention to provide a tassel assembly that is suited for use in a wide variety of decorative tassel and curtain tie-back applications.

It is a further object of this invention to provide a decorative tassel assembly that is very convenient for retailers to stock and order, and which significantly reduces the inventory problems associated with conventional tassels.

It is a further object of this invention to provide a decorative tassel assembly which can be quickly and conveniently modified by the storeowner to satisfy customer demands for a particular design.

It is a further object of this invention to provide a tassel assembly that provides the retailer with significantly improved efficiency, flexibility and convenience in meeting customer demand for popular tassel designs.

It is a further object of this invention to provide a decorative tassel assembly that permits retailers to significantly reduce overstocked inventory and the costs associated therewith.

This invention results from a realization that a decorative tassel assembly that employs interchangeable components will permit homeowners to freely and conveniently reassemble the tassel to suit their particular decorating tastes. Such a product also permits retailers to control their inventory requirements much more efficiently and cost effectively.

This invention features an multiple component tassel assembly that includes means defining a cord component for selectively engaging and hanging from a conventional article, such as a curtain rod, tie-back hook, chair, lamp or fan. There is a head component having a decorative configuration. Means are provided for releasably attaching the cord component to the head component. A tassel component includes a support member, a plurality of tassel strands and means for suspending the strands from the support member. There are means for releasably attaching the support member to the head component such that the head component depends from the cord component and the tassel component depends from the head component, when the cord component is hung from a conventional article.

In a preferred embodiment, the cord may include means defining at least one loop for hanging the assembly from the article with which the cord is engaged. A single loop may be used when the tassel assembly is used for strictly decorative purposes. Alternatively, a pair of loops may be formed in the cord when the tassel assembly serves as a curtain tie-back.

The means for releasably attaching the cord to the head component may include an upper, exteriorly threaded male connector element carried by one of the cord and the head component. Such means for releasably attaching may also include an upper, interiorly threaded female connector element carried by the other of the cord and the head component. The upper male and female connector elements are threadably and releasably interengaged to attach the cord to the head component. The means for releasably attaching the cord to the head component may further include a cup-like receptacle that receives the cord. Typically, the cord is adhesively fastened within the receptacle. The upper male connector element may depend from and be unitarily connected to the receptacle. Preferably, each of the upper male and female connector elements includes no more than a single thread. The upper male and female connector elements are preferably distinct from and attached to the cord and the head component, respectively.

The means for releasably attaching the lower support member to the head component may likewise include a lower, exteriorly threaded male connector element carried by one of the lower support member and the head component, as well as a complementary lower, interiorly threaded female connector element carried by the other of the lower support member and the head component. The lower male and female connector elements are threadably and releasably interengaged to attach the lower support member to the head component. Typically, each of the lower male and female connector elements includes not more than a single thread. The lower male and female connector elements may be distinct from and attached to the lower support member and the head component, respectively.

In alternative embodiments, each means for releasably attaching may comprise a magnet and a complementary magnetically attractable element. A first magnet is carried by one of the cord component and the head component. A complementary first magnetically attractable element is carried by the other of the cord component and the head component. Likewise, a second magnet is carried by one of the head component and the tassel component and a second complementary magnetically attractable element is carried by the other of the head component and the tassel component. Each magnet is releasably and magnetically engaged with its complementary magnetically attractable element to interconnect the cord, tassel and head components. This version may also employ a receptacle as described above.

An upper fringe-like covering may surround and obscure the receptacle. The tassel component may include a skirt portion, preferably fringed, that surrounds and is attached to the lower support member. Multiple tassel strands typically depend from the skirt portion. The skirt portion may extend above an upper edge of the lower support member to hide a seam formed between the head component and the support member when the lower support member is attached to the head component.

DETAILED DESCRIPTION OF PREFERRED EMBODIMENTS

Other objects, features and advantages will occur from the following description of preferred embodiments and the accompanying drawings, in which.

Figure 1:
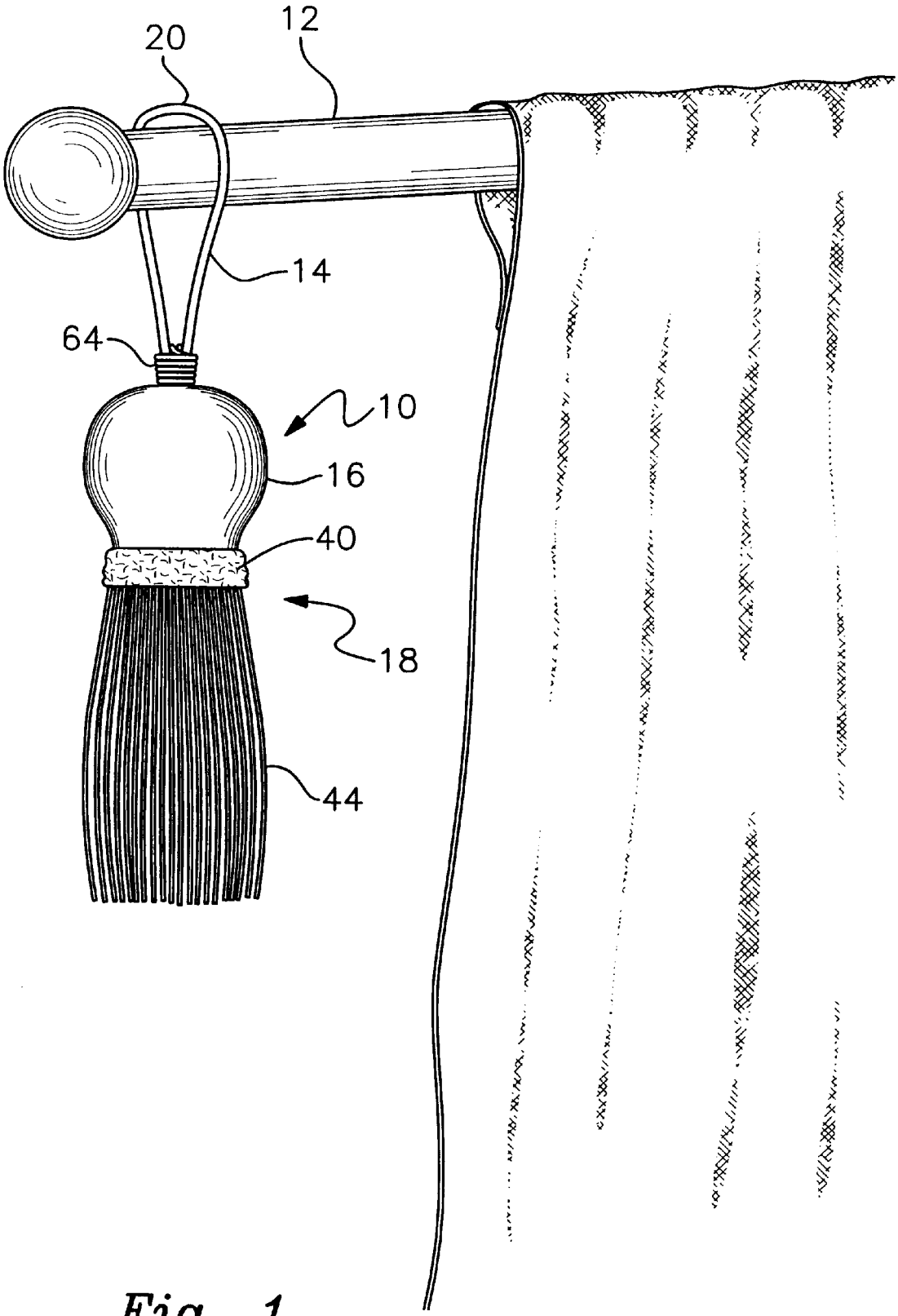
FIG. 1 is a perspective view of a fully constructed tassel assembly, according to this invention, which assembly is hanging from a conventional curtain rod.

There is shown in FIG. 1 a tassel assembly 10 that includes interchangeable components in accordance with this invention. Tassel assembly 10 is a hanging tassel and is used for decorative purposes in a manner that is well known. In particular, the illustrated tassel is hung from a conventional curtain rod 12. Tassel 10 may also be hung from a wide variety of other articles, such as chairs, lamps, fans, etc. in a known manner. Alternatively, as is described more fully below, the tassel assembly of this invention may be employed as a curtain tie-back. The function of such tie-back devices is also well known and should be understood to those skilled in the art.

Figure 2:
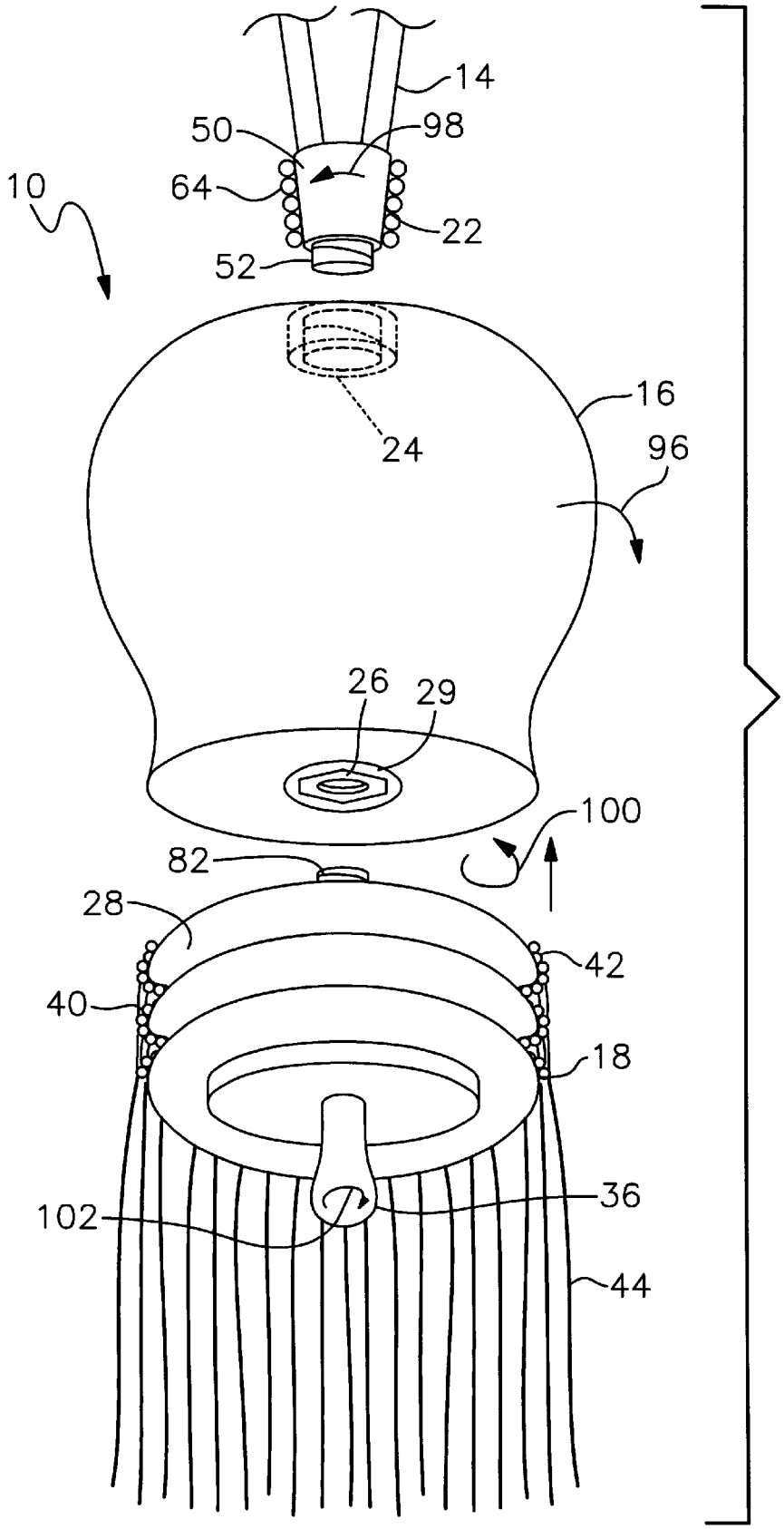
FIG. 2 is an exploded, perspective and partly cut away view of the tassel assembly.
Figure 3:
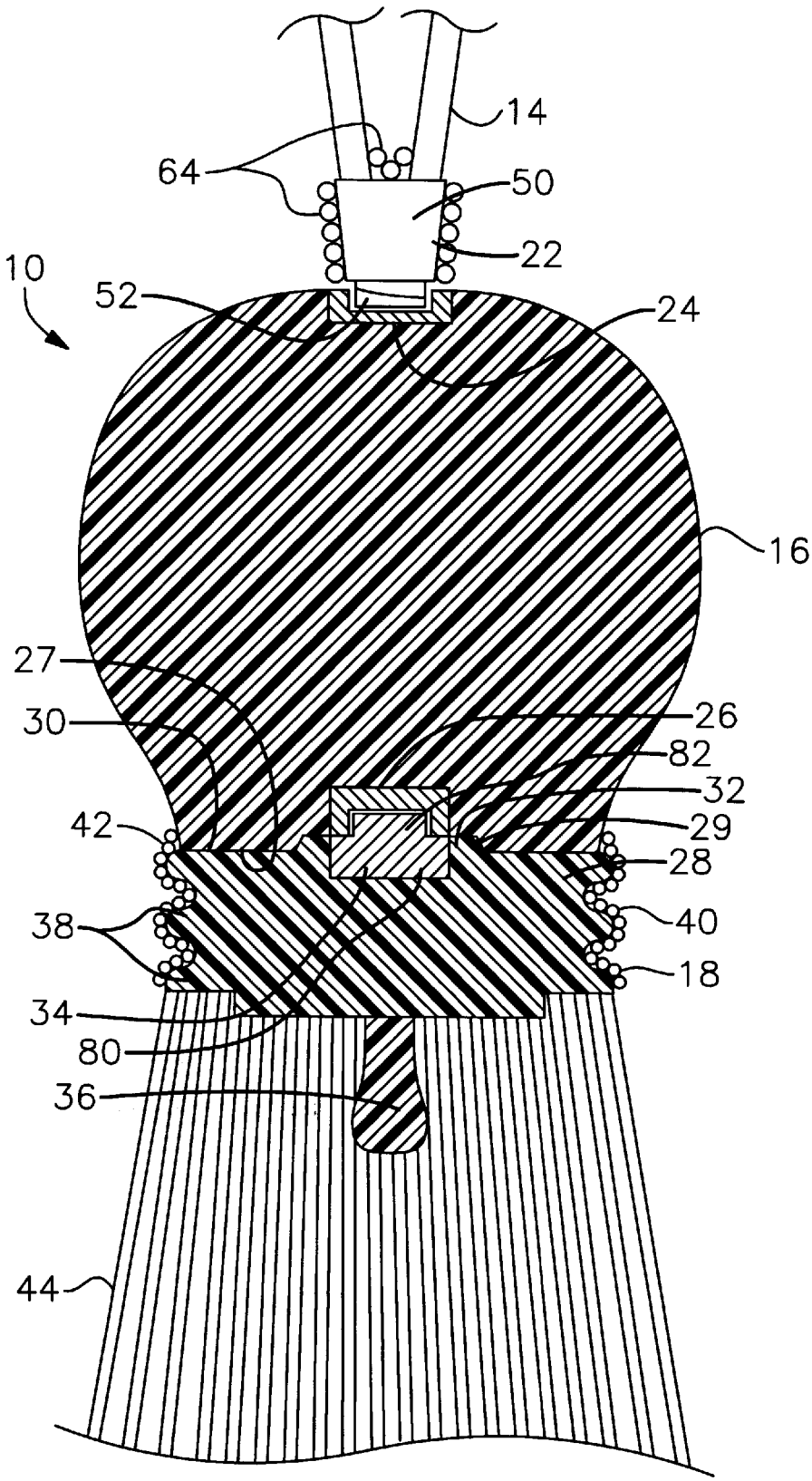
FIG. 3 is an elevational, cross sectional view of the tassel assembly in a fully assembled condition.

As shown in FIG. 1 and more fully in FIGS. 2 and 3, tassel assembly 10 includes three principal parts: an upper cord component 14, an intermediate head component 16 and a lower tassel component 18. In the prior art, these components are fastened together permanently. The parts cannot be interchanged. Absolutely no flexibility is provided for accommodating differing decorative tastes. Furthermore, storeowners have little flexibility when ordering and stocking different designs. Tassel assembly 10 overcomes the above problems by utilizing separate and distinct, interchangeable components.

Cord 14 typically comprises a fibrous natural or synthetic rope material. The cord includes a single loop 20 in FIGS. 1–3. As best shown in FIG. 1, loop 20 may be utilized to hang assembly 10 from an item such as curtain rod 12. In alternative embodiments, a pair of loops may be used so that the tassel assembly may serve as a curtain tieback. In still other embodiments, loops may be omitted altogether. The presence and number of loops is determined by the particular hanging application for which the tassel assembly is designed.

Intermediate head component 16 includes a decorative shape or configuration. In the embodiment disclosed in FIG. 3, the head component has a bulbous or rounded shape. In alternative versions, the head component may feature a wide variety of arbitrary and natural shapes. A virtually limitless variety of ornamental designs may be depicted. It is anticipated that animal heads and gargoyles may be particularly popular. The decorative shapes may be selected as appropriate for various holiday seasons and celebrations. Head component 16 may be composed of a wide variety of materials including wood, synthetics, ceramics, as well as various combinations of such materials. In some cases, a leather or fabric covering may be applied over an underlying form. The particular shapes and materials of construction are not a limitation of this invention. The lower end of head component 16 includes a bottom surface 27 having a central recess 29.

Tassel component 18 comprises an underlying support member 28, best shown in FIGS. 2 and 3. The support member is composed of wood, plastic or ceramic material. As best shown in FIG. 3, the upper surface 30 of member 28 includes a central, raised portion 32. Raised portion 32 has a shape that complements the shape of central recess 29 in the bottom of head component 16. A handle 36 depends from the lower surface of support member 28. In certain embodiments, the handle may be omitted. The support member includes a peripheral surface having a plurality of annular ribs or flanges 38. A tassel skirt 40, typically comprising a fringe material, wraps about ribs 38 of member 28. The ribs or flanges help to retain or hold the skirt securely onto the support member. In alternative embodiments, the ribs can be eliminated or their configuration can be changed. Adhesive may also be used to help hold the skirt onto the support member. The upper end 42 of skirt 40 extends somewhat above the upper surface 30 of support member 28. The importance of this feature is described more fully below. A plurality of conventional fibrous tassel strands 44 are attached to and hang from skirt 40. In this manner, the tassel strands are suspended from support member 28.

Figure 4:
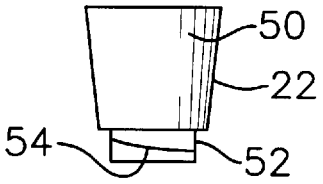
FIG. 4 is an elevational view of the upper attachment piece.

Cord component 14 and tassel component 18 are releasably attached to the upper and lower ends, respectively, of decorative head component 16. As shown in FIGS. 2 and 3, an attachment piece 22 is carried by cord 14. Attachment piece 22, shown alone in FIG. 4, includes a generally tubular or cup-like receptacle 50 and an exteriorly threaded male connector element 52 that is unitarily attached to and depends from receptacle 50. Preferably, piece 22 is formed from a durable metal or molded plastic and is manufactured in one piece according to various known manufacturing techniques. Connector element 52 has a diameter that is slightly less than that of cup element 50, although in alternative embodiments the diameters may be the same. A circumferential thread 54 is formed about the exterior surface of connector element 52. Preferably, thread 54 extends not more than one complete turn or revolution about element 52. The importance of this construction is described more fully below.

Figure 5:
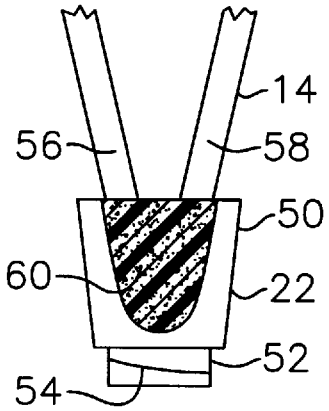
FIG. 5 is an elevational, partly cut away view of the upper attachment piece with the hanging cord received and adhesively secured therein.

As shown in FIG. 5, lower ends 56 and 58 of cord 14 are inserted into receptacle 50. A suitable adhesive 60 is introduced into the receptacle so that attachment piece 22 is permanently fastened to and carried by cord 14. Receptacle 50 serves to accommodate the cord. In alternative versions, this receptacle can be omitted and the cord is attached directly to a threaded member or other type of connector.

After the attachment piece is secured to the cord in the above described manner, a fringed covering 64, FIGS. 1–3, is applied to the attachment piece such that it encloses receptacle 50. This is done primarily for aesthetic purposes and to obscure the metallic or plastic attachment piece when the tassel is fully assembled. Covering 64 may be adhesively secured to the attachment piece or simply woven about the attachment piece without the use of adhesive.

Figure 6:
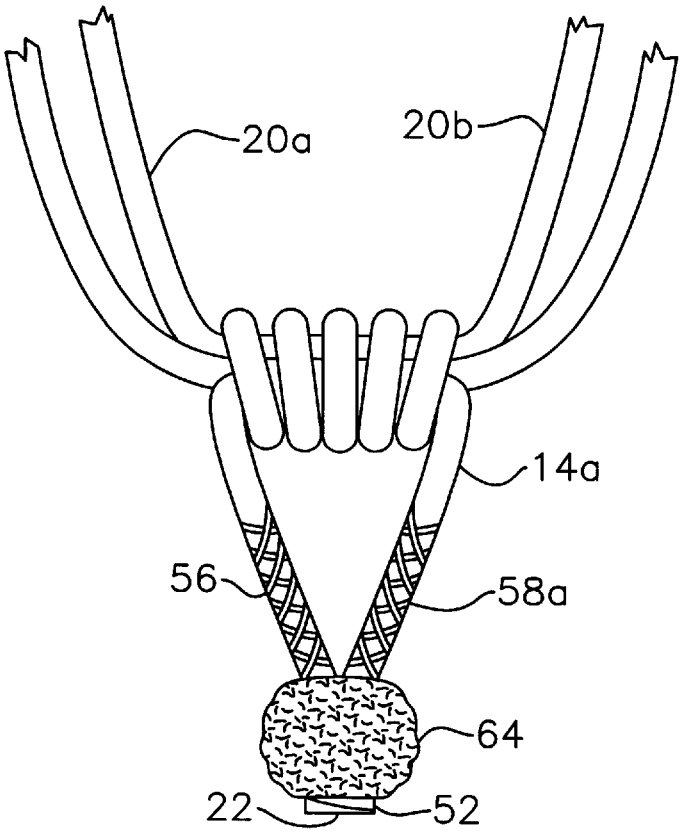
FIG. 6 is an elevational view of a version of the hanging cord, which has a pair of loops to enable the completed device to serve as a curtain tieback; the upper attachment piece and decorative covering for that component are carried at the lower end of the cord.

A completed cover 64, as used with an alternative version of the cord, is illustrated in FIG. 6. Therein, a cord 14*a*, of the type used in curtain tie-backs is depicted. Cord 14*a* employs a pair of loops 20*a* and 20*b*, which are selectively attached to a hook or bracket so that the cord may function as a tie-back. Nonetheless, the cord also includes a pair of ends 56*a* and 58*a* that are permanently secured to an attachment piece 22 in the manner illustrated in FIGS. 4 and 5. Covering 64 again largely obscures the attachment piece. Only the lower end of threaded connector element 52 is exposed from the bottom of the fringe covering. As is shown best in FIGS. 1 and 3, the covering obscures attachment piece 22 entirely when the cord is releasably attached to the head component. Such attachment occurs as follows.

Figure 7:
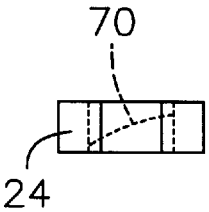
FIG. 7 is a side elevational view of the threaded female connector used for the upper and lower head inserts.
Figure 9:
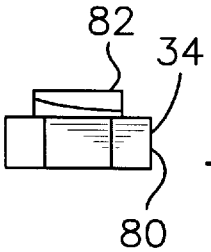
FIG. 9 is a side elevational view of the lower male connector.
Figure 8:
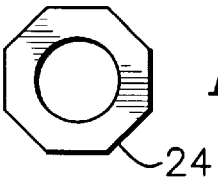
FIG. 8 is a top view of the female connector.
Figure 10:
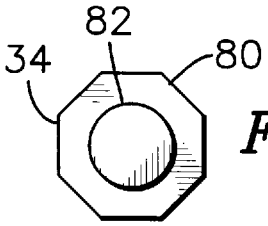
FIG. 10 is a top view of the lower male connector.

Head component 16 carries a pair of upper and lower female connector elements 24 and 26, respectively. A representative one of the elements 24 is shown in FIGS. 7 and 8. It should be understood, however, that lower connector female connector 26 typically comprises a similar or identical size and configuration. In particular, each female connector element comprises an interiorly threaded nut or insert that is received in a corresponding cavity or recess formed in head component 16. Upper female connector element 24 is inset in a recess formed proximate the top or crown of head portion 16. Element 24 may be secured adhesively within the recess. Alternatively, the recess may be cut to securely retain the upper female connector element in a tight, close tolerance fit therein. Lower connector element 26 is likewise fixed in a recess formed in the bottom surface of the head component. As best illustrated in FIGS. 2 and 3, the bottom surface 27 of head component 16 includes an indent 29 in which a cavity or recess is formed for accommodating lower female connector element 26. Again, the lower female connector element may be secured within this recess by an adhesive, a close tolerance fit, or other means. In alternative embodiments, the upper and lower female connector elements may be formed unitarily with the head component. The opening in the female connector elements are exposed from the upper and lower surfaces of the head component. As depicted in FIG. 7, connector element 24, and analogously connector element 26, each includes a single turn interior circumferential thread 70.

Tassel component 18 carries a lower attachment piece 34 that is inset into and exposed from upper surface 30, and more particularly central raised portion 32, of support member 28. Piece 34, shown alone in FIGS. 9 and 10, includes a base portion 80 that is fixedly received in a corresponding cavity in support member projection 32. A central, exteriorly threaded male connector portion 82 is connected unitarily to base portion 80 and extends upwardly therefrom, as shown in FIGS. 2, 3, 9 and 10. As a result, threaded male connector 82 is exposed from the upper surface of support member 28 so that it is able to engage lower female connector 26 carried by head component 16. Once again, connector 82 employs a thread 83 that extends only a single turn about the connector.

The dimensions and tolerances of male connector elements 52 and 82 are constructed such that those connector elements are threadably engagable with upper and lower female connector elements 24 and 26, respectively. More particularly, threaded male connector element 52 of attachment piece 22 is threadably interengagable with female connector element 24, and male connector element 82 of attachment piece 34 is similarly threadably interengagable with lower female connector element 26. Otherwise, the precise dimensions and tolerances used for the attachment pieces and complementary male and female threads may be varied within the scope of this invention.

The individual components of tassel assembly 10 are selectively interengaged and disengaged in the following manner. Cord 14 is releasably attached to head component 16 by inserting threaded male connector element 52 into the opening of threaded female connector element 24 and turning the cord and head component in appropriate opposite directions (i.e. in the opposing directions of arrows 96 and 98 in FIG. 2,). As a result, the attachment piece is screwed into head component 16 and cord 14 is attached to the head component. Of course, these components may be similarly coupled by engaging the male and female connectors and holding either the cord component or the head component still while the other component is rotated.

Likewise, tassel component 18 may be selectively coupled with head component 16. This is accomplished by inserting lower male connector element 82 into lower female connector element 26. The head component 16 and the tassel component 18 are rotated relative to each other, as indicated by arrows 100 and 102 in FIG. 2. The tassel component is most conveniently rotated by turning handle 36. In alternative embodiments, the handle may be omitted and the homeowner may simply rotate the entire lower support member 28 in a similar direction. In any event, this rotation (or rotation of simply one of the components) causes support member 28 of tassel component 18 to screw into and releasably attach to the head component. Because each of the upper and lower male and female connector elements employs only a single circumferential thread, the above described connecting operations are performed quickly and conveniently with a minimum of effort. The assembler is required to make no more than a single rotation whenever either the cord or the tassel component is attached to the head component.

FIG. 1 illustrates tassel assembly 10 with the cord component 14, head component 16 and tassel component 18 releasably interconnected in the above described manner. FIG. 3 best illustrates the interengaged relationship between upper male and female connectors 52 and 24, respectively, and lower male and female connectors 82 and 26, respectively, when tassel assembly 10 is fully interconnected. In this condition, male connector element 52 is fully received within female connector element 24. Covering 64 obscures receptacle 50 of attachment piece 22. See also FIG. 1. Tassel component 18 is attached to the lower end of head component 16 such that central raised portion 32 of support member 28 is received in the complementary shaped recess 29. The lower end 27 of head component 16 and the upper end 30 of support member 28 interengage in a generally flush manner. The upper end 42 of fringed tassel skirt 40 extends above the upper end 30 of the support member and thereby covers the seam created between upper end 30 and lower end 27 of head component 16. This improves the aesthetic appearance of the tassel considerably and provides the assembly with an attractive unbroken appearance.

Disassembly of the principal components is performed simply by reversing the above described operation. The attachment piece and accompanying cord are rotated axially relative to the head component in a reverse direction to disengage upper male connector 52 from upper female connector 24. Likewise, support member 28 and attached piece 34 are rotated axially relative to head component 16 in a manner opposite to that previously described so that the lower male connector element 82 is disengaged from the lower female connector element 26. The cord component and the tassel component may then be releasably interengaged with alternative decorative head components as desired. Disassembly is similarly quick and convenient due to the single thread construction employed by each of the mate and female connector elements. A minimum of turning time and effort are required.

Figure 11:
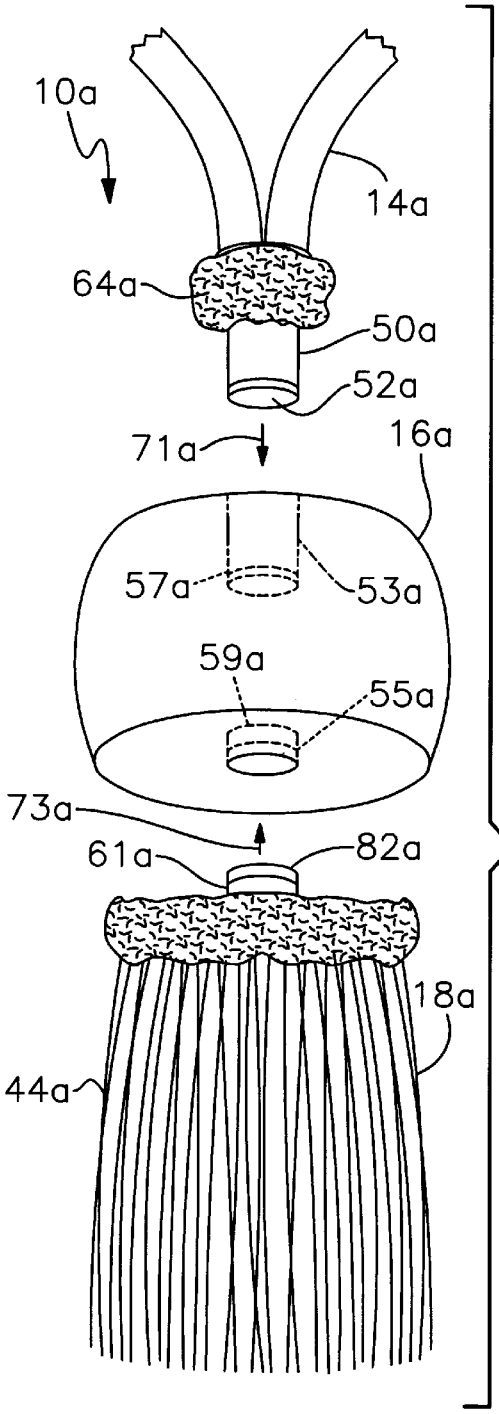
FIG. 11 is an exploded view of an alternative tassel assembly according to this invention, which employs magnetic means for releasably interconnecting the components.

There is shown in FIG. 11 an alternative multiple part tassel assembly 10*a* in accordance with this invention. Once again, a cord component 14*a* is releasably attached to an upper end of a decorative head component 16*a* and a tassel component 18*a* is releasably attached to the bottom of head component 16*a*. The cord component, head component and tassel component are constructed identically or analogously to the components in the previously described version. This embodiment differs from the prior embodiment primarily because magnetic means are employed to releasably interconnect the cord component and the tassel component to the head component.

Figure 12:
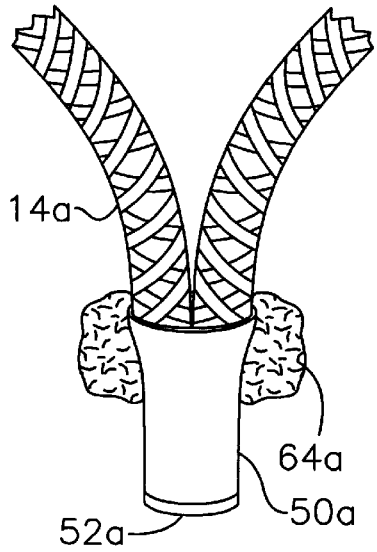
FIG. 12 is a perspective view of the cord component used in the second embodiment of this invention.

As shown in FIG. 12, the ends of cord component 14*a* are received by and fixed (e.g., adhesively) within a generally tubular receptacle 50*a*. Fringe 64*a* is again formed about the receptacle. A first disk-shaped magnet 52*a* is mounted adhesively or in some other manner to the lower end of receptacle 50*a*. See also FIG. 11. Magnet 52*a* may comprise iron, nickel or some other known magnetic material.

Head component 16*a*, FIG. 11, includes a generally cylindrical upper channel 53*a* and a generally cylindrical lower channel 55*a* which are formed, respectively, in the top and bottom of head component 16*a*. Channels 53*a* and 55*a* are generally aligned. A disk-shaped element 57*a*, which is composed of a magnetically attractable material (typically a metal) is disposed at the bottom of channel 53*a*. Similarly, a second disk-like element 59*a* composed of a magnetically attractable metal, is disposed at the inner end of channel 55*a*. Elements 57*as* and 59*a* are held in place within their respective channels by an appropriate adhesive.

Tassel component 18*a* again includes a support member, which is obscured by tassel strands 44*a* depending therefrom. A central shaft or dowel 61*a* is attached to and protrudes axially upwardly from the support member of tassel component 18*a*. A second disk-like magnet 82*a* is fixed adhesively or otherwise to the upper end of shaft 61*a*. This magnet is identical or similar in construction, size and shape to first magnet 52*a*.

Channels 53*a* and 55*a* have diameters that are sufficiently great to receive receptacle 50*a* and shaft 61*a*, respectively. The disk-like magnets 52*a* and 82*a* should similarly have a diameter that permits them to fit easily into channels 53*a* and 55*a*, respectively. The cord and head components are releasably interconnected by inserting receptacle 50*a* into channel 53*a* in the direction of arrow 71*a*, until magnet 52*a* engages and releasably adheres to magnetically attractable element 57*a*. Tassel component 18*a* is similarly releasably attached to the bottom of head component 16*a*. Axial shaft 61*a* is inserted into lower channel 55*a* in the direction of arrow 73*a*. Magnet 82*a* engages and magnetically adheres to element 59*a* at the inner end of channel 55*a*.

Cord component 14*a* and tassel component 18*a* are magnetically secured to the upper and lower ends, respectively, of head component 16*a* in the above described manner. The first and second magnets and respective, complementary first and second magnetically attractable elements are selected to provide a magnetic adhesion that securely joins the components 14*a*, 16*a* and 18*a* together, but at the same time, permits those components to be readily released when they are pulled apart by a person. The amount of pulling force required to separate the components may be conveniently adjusted by selecting magnets and magnetically attracted components having desired sizes and magnetic strengths.

Accordingly, the present invention permits homeowners to quickly, conveniently and flexibly interchange the individual pieces of a tassel assembly so that distinct, custom designs may be achieved. At the same time, the retailer's inventory requirements, expenses and risk of loss are reduced considerably.

It should be understood that various other forms of releasable interconnection may be provided between the cord and tassel components and the decorative head component. A wide variety of threaded assemblies may be utilized. In certain versions, the male connector components may be carried by the head component and the female connector elements may be carried by the cord and tassel components. One alternative form of releasable interconnection may include screw rivets, wherein a rivet fastener is carried by one of the components of the assembly and a screw, threadably engagable with the rivet, is carried by the other component.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A multiple component tassel assembly comprising:

means defining a cord component, which is selectively engaged with and hung from a conventional supporting article;

a head component having a decorative configuration;

means for releasably attaching said cord component to an upper portion of said head component;

a tassel component, which includes a support member, a plurality of tassel strands and means for suspending said strands from said support; and means for releasably attaching said support member to a lower portion of said head component, whereby said head component depends from said cord component and said tassel component depends from said head component when said cord is hung from a conventional supporting article;

said means for releasably attaching said cord component to said head component being separate and distinct from and spaced above said means for releasably attaching said support member to said head component.

2. The assembly of claim 1 in which said cord component includes means defining at least one loop for engaging the article on which said cord is hung.

3. The assembly of claim 1 in which said means for releasably attaching said cord component to said head component includes an upper, exteriorly threaded male connector element carried by one of said cord component and said head component and a complementary upper, interiorly threaded female connector element carried by the other of said cord component and said head component, said upper male and female connector elements being threadably and releasably interengaged to attach said cord component to said head component.

4. The assembly of claim 3 in which said means for releasably attaching said cord component and said head component include a receptacle that receives said cord.

5. The assembly of claim 4 in which said cord is adhesively fastened within said receptacle.

6. The assembly of claim 4 in which said upper male connector element depends from said receptacle.

7. The assembly of claim 6 in which said upper male connector is unitarily connected to said receptacle.

8. The assembly of claim 3 in which each of said upper male and female connector elements includes not more than a single thread.

9. The assembly of claim 3 in which said upper male and female connector elements are distinct from and attached to said cord and said head component, respectively.

10. The assembly of claim 4 further including an upper covering that surrounds and obscures said receptacle.

11. The assembly of claim 1 in which said means for releasably attaching said support member to said head component include a lower, exteriorly threaded male connector element carried by one of said support member and said head component and a complementary lower, interiorly threaded female connector element carried by the other of said support and said head component, said lower male and female connector elements being threadably and releasably interengaged to attach said lower support member to said head component.

12. The assembly of claim 11 in which each of said lower male and female connected elements includes not more than a single thread.

13. The assembly of claim 11 in which said lower male and female connector elements are distinct from and attached to said support member and said head component, respectively.

14. The assembly of claim 1 in which said tassel component includes a skirt portion that surrounds and is separate and distinct from and attached to said support member and multiple tassel strands that depend from said skirt portion.

15. The assembly of claim 14 in which said skirt portion extends above an upper edge of said support member to hide a seam formed between said head component and said support member when said support member is attached to said head component.

16. The assembly of claim 1 in which said means for releasably attaching said cord component to said head component includes an upper magnet carried by one of said cord component and said head component and a complementary upper magnetically attractable element carried by the other of said cord component and said head component, said upper magnet and said upper magnetically attractable element being magnetically and releasably interengaged to attach said cord component to said head component.

17. The assembly of claim 16 in which said means for releasably attaching said cord component and said head component include a receptacle that receives said cord and to which one of said upper magnet and said upper magnetically attractable element is secured.

18. The assembly of claim 1 in which said means for releasably attaching said support member to said head component include a lower magnet carried by one of said support member and said head component and a complementary lower magnetically attractable element carried by the other of said support and said head component, said lower magnet and said lower magnetically attractable element being magnetically and releasably interengaged to attach said lower support member to said head component.

19. A multiple component tassel assembly comprising:

means defining a cord component, which is selectively engaged with and hung from a conventional supporting article;

a head component having a decorative configuration;

means for releasably attaching said cord component to said head component;

a tassel component, which includes a support member, a plurality of tassel strands and means for suspending said strands from said support; and means for releasably attaching said support member to said head component, whereby said head component depends from said cord component and said tassel component depends from said head component when said cord is hung from a conventional supporting article;

said means for releasably attaching said cord component to said head component including an upper, exteriorly threaded male connector element carried by one of said cord component and said head component and a complementary upper, interiorly threaded female connector element carried by the other of said cord component and said head component, said upper male and female connector elements being threadably and releasably interengaged to attach said cord component to said head component.

20. A multiple component tassel assembly comprising:

means defining a cord component, which is selectively engaged with and hung from a conventional supporting article;

a head component having a decorative configuration;

means for releasably attaching said cord component to said head component;

a tassel component, which includes a support member, a plurality of tassel strands and means for suspending said strands from said support; and means for releasably attaching said support member to said head component, whereby said head component depends from said cord component and said tassel component depends from said head component when said cord is hung from a conventional supporting article;

said means for releasably attaching said support member to said head component including a lower, exteriorly threaded male connector element carried by one of said support member and said head component and a complementary lower, interiorly threaded female connector element carried by the other of said support and said head component, said lower male and female connector elements being threadably and releasably interengaged to attach said lower support member to said head component.

21. A multiple component tassel assembly comprising:

means defining a cord component, which is selectively engaged with and hung from a conventional supporting article;

a head component having a decorative configuration;

means for releasably attaching said cord component to said head component;

a tassel component, which includes a support member, a plurality of tassel strands and means for suspending said strands from said support; and means for releasably attaching said support member to said head component, whereby said head component depends from said cord component and said tassel component depends from said head component when said cord is hung from a conventional supporting article;

said means for releasably attaching said cord component to said head component including an upper magnet carried by one of said cord component and said head component and a complementary upper magnetically attractable element carried by the other of said cord component and said head component, said upper magnet and said upper magnetically attractable element being magnetically and releasably interengaged to attach said cord component to said head component.

22. A multiple component tassel assembly comprising:

means defining a cord component, which is selectively engaged with and hung from a conventional supporting article;

a head component having a decorative configuration;

means for releasably attaching said cord component to said head component;

a tassel component, which includes a support member, a plurality of tassel strands and means for suspending said strands from said support; and means for releasably attaching said support member to said head component, whereby said head component depends from said cord component and said tassel component depends from said head component when said cord is hung from a conventional supporting article;

said means for releasably attaching said support member to said head component including a lower magnet carried by one of said support member and said head component and a complementary lower magnetically attractable element carried by the other of said support and said head component, said lower magnet and said lower magnetically attractable element being magnetically and releasably interengaged to attach said lower support member to said head component.

* * * * *